US005368535A

United States Patent [19]

Twardokens

[11] Patent Number: 5,368,535

[45] Date of Patent: Nov. 29, 1994

[54] ROTARY WEIGHTED EXERCISING DEVICE

[75] Inventor: George Twardokens, Reno, Nev.

[73] Assignee: Magna Tech Orthopedic, Inc., Cedar Flat, Calif.

[21] Appl. No.: 978,349

[22] Filed: Nov. 18, 1992

[51] Int. Cl.[5] ..... A63B 21/06

[52] U.S. Cl. ..... 482/79; 482/100; 482/147

[58] Field of Search ..... 482/79, 80, 146, 93, 482/98, 99, 100, 101, 102, 136, 907, 147

[56] References Cited

U.S. PATENT DOCUMENTS

| | | | |
|---|---|---|---|
| 3,072,400 | 1/1963 | Dykinga | 482/102 |
| 3,702,188 | 11/1972 | Phillips et al. | 482/79 |
| 4,515,363 | 5/1985 | Schleffendorf | 482/100 |
| 4,577,861 | 3/1986 | Bangerter et al. | 482/79 |
| 4,625,959 | 12/1986 | Schleffendorf | 482/136 |
| 5,044,629 | 9/1991 | Ryan et al. | 482/101 |

FOREIGN PATENT DOCUMENTS

| | | | |
|---|---|---|---|
| 0735331 | 5/1966 | Canada | 482/102 |

*Primary Examiner*—Stephen R. Crow
*Attorney, Agent, or Firm*—Poms, Smith, Lande & Rose

[57] ABSTRACT

A rotary weighted exercising device having a base, and a rotary plate mounted on the base with upright guides for one's foot to rest therebetween. A weighted member is disposed on said base movable from a first position adjacent to the base to a second position extending away from the base. An elongated member is coupled at one end to the rotary plate and at the other end to the weighted member, the elongated member being guided between the rotary plate and the weighted member so that rotation of said rotary plate raises said weighted member.

12 Claims, 2 Drawing Sheets

ROTARY WEIGHTED EXERCISING DEVICE

BACKGROUND OF THE INVENTION

1. Field of the Invention

The invention relates to exercising devices; and, more particularly, to a rotary exercising device wherein one exercises against a weighted member, the tension of which can be adjusted.

2. Description of the Prior Art

Many knee injuries are the result of medial or lateral rotation coupled with varus or valgus stress. Although various devices have been suggested in the past, none of them show the following characteristics:

1. The use of a desired weight unit as a resistance which is displaced in a vertical plane as a result of an effort applied in the transverse plane.
2. A device that exercises rotators of the lower extremity through a concentric contraction (as the weight unit is lifted) and an eccentric contraction (as the weight unit is being lowered).
3. An intrinsic, closed feed-back loop control of each stroke of slowly performed rotary movements.
4. A "feel of movement" (kinesthesia) experienced by the user which is natural to human efforts which must overcome inertia.

There thus is a need for a device to exercise one's lower extremity which guarding the same against excessive rotational stress. Such a device should strengthen the muscles that are most involved in these movements and accommodate a variety of resistive forms. It should specifically exercise the lower extremity in rotational movements common in various sports.

SUMMARY OF THE INVENTION

It is an object of this invention to provide a rotary weighted exercising device.

It is a further object of this invention to provide such a device wherein the tension thereon can be adjusted.

It is still further an object of this invention to provide such a device wherein there is inertia to be overcome either at the initiation of a rotary movement or soon after initiation of the rotary movement.

These and other objects are accomplished by providing a device having a base and a rotary plate mounted in the base with upright guides for one's foot to rest therebetween. A weighted member is disposed on said base movable from a first position adjacent to the base to a second position extending away from the base. An elongated member is coupled at one end to the rotary plate and at the other end to the weighted member, the elongated member being guided between the rotary plate and the weighted member so that rotation of said rotary plate raises said weighted member.

DESCRIPTION OF THE PREFERRED EMBODIMENT

Figures 1, 2, 7:
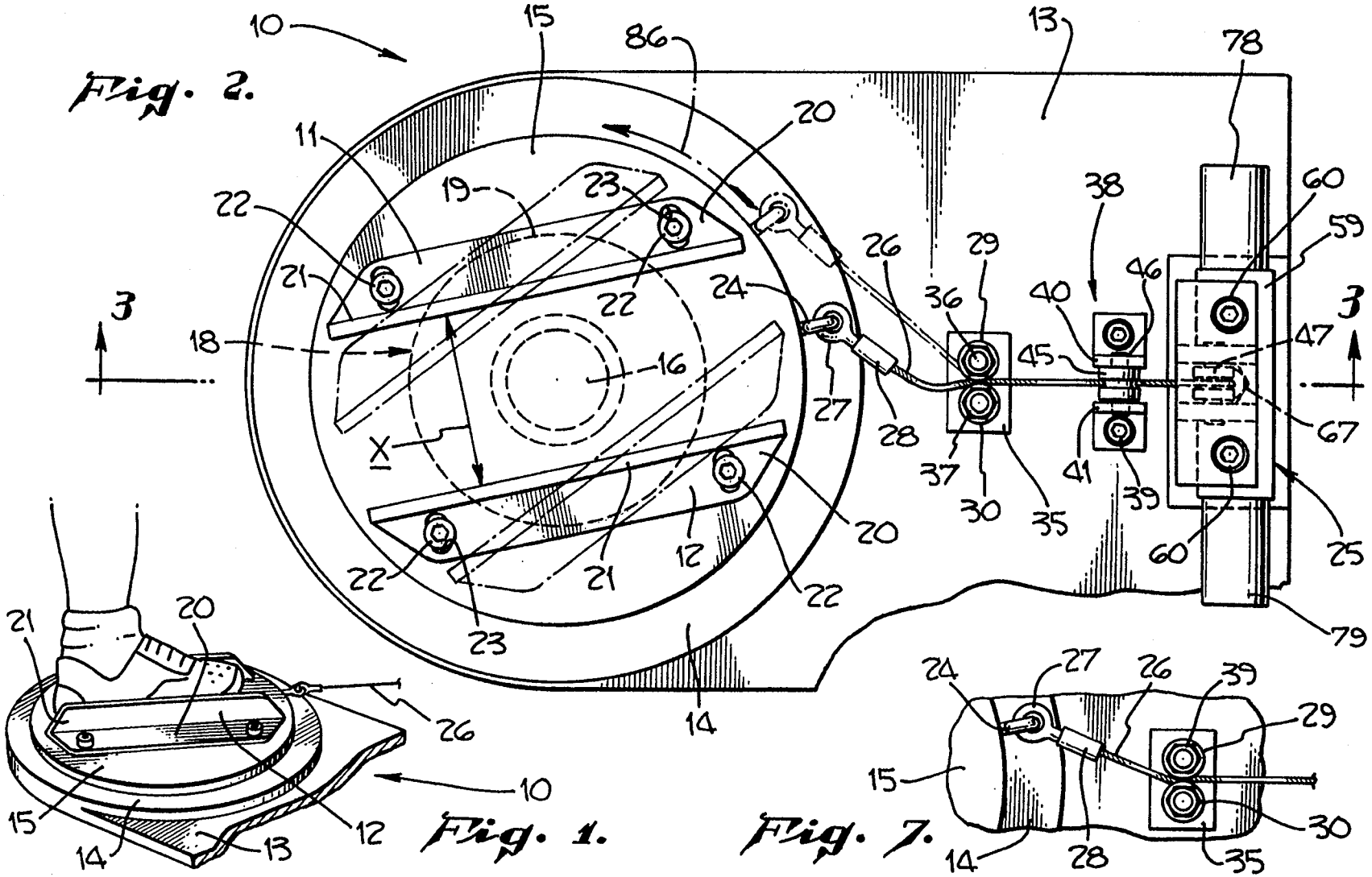
FIG. 1 is a perspective view showing operation of a portion of the device of the invention.
FIG. 2 is a top plan view of the device of the invention.
FIG. 7 is a detailed view showing another modification of the invention.

Referring now to FIG. 1 of the drawing, a self containing rotary device 10 is shown in partial perspective view with the foot of a user disposed thereon between spaced upright guide members in the form of flanges 11, 12, respectively.

Figures 3, 4, 5, 6:
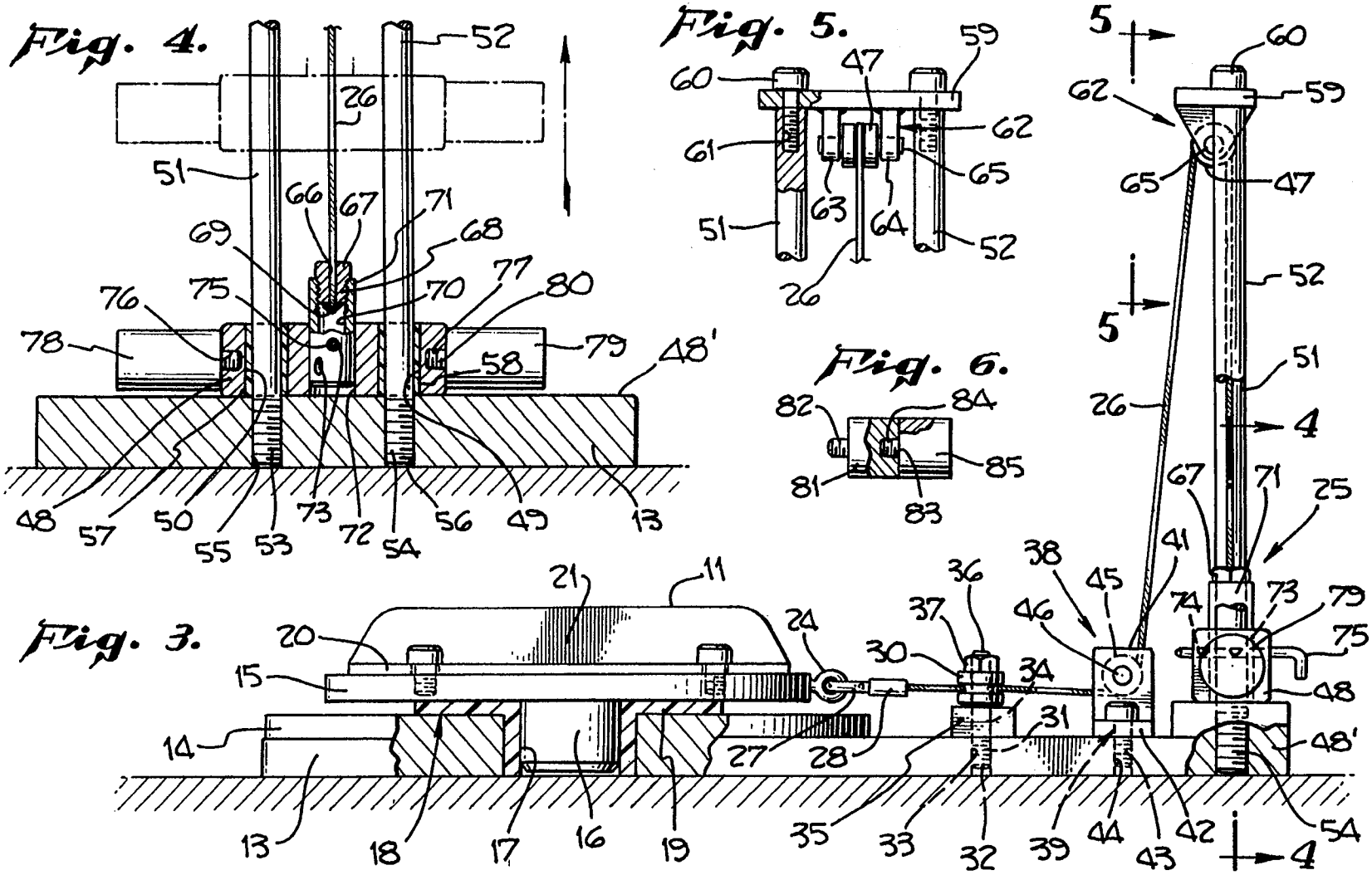
FIG. 3 is a view taken along lines 3—3 of FIG. 2.
FIG. 4 is a view taken along lines 4—4 of FIG. 3.
FIG. 5 is a view taken along lines 5—5 of FIG. 3.
FIG. 6 is a detailed plan view showing a modification of the invention.

The entire device 10 is shown in a top plan view in FIG. 2 and a side view, partly in section, in FIG. 3. As seen in FIG. 2, device 10 includes a generally flat planar base plate 13 (see also FIG. 1). A generally circular support plate 14 is fixedly secured in any suitable manner to base plate 13. A lazy-susan type rotary plate 15 is mounted on top of plate 14. Plate 15 is rotatable with respect to plate 14 in any suitable manner. For example, as seen in FIG. 3, plate 15 may have a centrally located downwardly extending bearing 16 extending into a like configured cavity 17 in a resilient bearing member 18. Bearing member 18 has a generally flat circular portion 19 disposed between plates 14 and 15. Of course, any suitable bearings or similar arrangement may be used to allow plate 15 to rotate with respect to plate 14.

A pair of spaced flanges 11, 12, flange 12 shown in FIG. 3, are provided, each flange having a flat base portion 20 (see FIG. 2) and an integral upright portion 21 (see FIGS. 1 and 3).

The spacing or distance x (FIG. 1) between upright portions 21 is generally related to the width of a user's foot wearing a shoe or sneaker or the like. The upright portions 21 can be set in the form of a wedge (defined between the portions 21) to accommodate various shoe size without adjustments by pressing the heel of the shoe backward until firm contact with the flanges 11, 12, is obtained.

The flat base portions 20 are secured to rotary plate 14 by spaced screws or nuts and bolts 22 extending through suitable apertures in plate 14 and elongated holes 23 in flat base portions 20 to allow for slight adjustment of spacing x.

An eye hook 24 is integrally connected to the periphery of rotary plate 15 adjacent weighted apparatus 25. Eyehook 24 is coupled to an elongated member, such as a woven wire cable 26, having one end 27 clamped via clamp 28, secured to eyehook 24 extending between a pair of spaced grooved sheaves 29, 30 (see also FIG. 3—only sheave 30 being visible). Sheaves 29, 30 are mounted on shafts 31 having a threaded end 32 threaded into a suitable aperture 33 in base plate 13, a smooth midportion 34 extending through both a spacer block 35 and each sheave 29, 30, terminating in a second threaded end 36 having nut 37 threaded thereon firmly holding sheaves 29, 30 in position. Block 35 may be welded or otherwise secured to base plate 13 (which may be of metal). The sheaves 29, 30 thus freely rotate on shafts 31, their peripheries being substantially contiguous, with cable 26 passing through the grooves in sheaves 29, 30. A yoke member 38 is mounted to base plate 13 having a pair of upwardly extending spaced arms 40, 41 (see FIG. 1). Yoke member 38 is secured to base plate 13 in any suitable manner, such as by a threaded bolt 39 extending through the base 42 of yoke member 38 and having a threaded shaft 43 threaded into a suitable aperture 44 in base member 13. A grooved sheave 45 is mounted for rotation between arms 40, 41 by a suitable pin 46 (FIG. 3).

As seen in FIG. 3, cable 26 passes under the groove of sheave 45 and to a like grooved sheave 47 (FIG. 3) at the top of weighted apparatus 25, as will be discussed (see also FIG. 5).

As seen in FIG. 3, weighted apparatus 25 includes a base member 48 (see also FIG. 4) having a pair of spaced apertures 49, 50 therethrough. Base member 48 is loosely mounted on top of a sub-base 48' secured to base plate 13 by any suitable means. Base member 48 rides along spaced members in the form of rods 51, 52 having threaded ends 53, 54, respectively, threaded into suitable apertures 55, 56, respectively, in sub-base 48' and base plate 13. Rods 51, 52 extend through bearing collars 57, 58 disposed in apertures 49, 50, respectively.

Rods 51, 52 extend to and terminate at top in top plate 59 (FIGS. 1, 3, and 5). The upper ends of rods 51, 52 are secured to top plate 59 by threaded bolts 60 (FIG. 5) extending through plate 59 and threaded into suitable threaded apertures 61 in the upper ends of rods 51, 52.

A yoke member 62 is welded or otherwise secured to plate 59 between rods 51, 52. Yoke member 62 has a pair of downwardly extending spaced flanges 63, 64 with aforementioned sheave 47 disposed therebetween. Sheave 47 is rotatably mounted between flanges 63, 64 by pin 65 extending through aligned apertures in sheave 47 and flanges 63, 64.

As seen in FIGS. 3 and 5, cable 26 extends from rotary plate 15, through sheaves 29, 30, under sheave 45, up and over sheave 47, then down to base member 48. As seen in FIG. 4, cable 26 extends through an aperture 66 in a nut 67 having an integral threaded shaft 68 and out of shaft 68 and welded or otherwise secured thereto as at weld 69. Shaft 68 is thus threaded into threaded hole 70 in an elongated mounting pin 71 loosely mounted in an aperture 72 in base member 48. One or more spaced holes 73 may be provided through pin 71. A hole 74 (FIG. 3) may be provided through base member 48. In this manner, a locking pin 75 may be inserted into hole 74 and through one of holes 73 to vary the height of pin 71 with respect to base member 48. Further, nut 67 may be threaded or unthreaded to also vary the height. This of course increases or decreases the tension of cable 26.

Threaded apertures 76, 77 (FIG. 4) are provided at opposite sides of base member 48 having longitudinal axes extending generally parallel to the plane of the upper surface of base member 48. A pair of weights 78, 79, each having an integral threaded shaft 80, is threaded into apertures 76, 77, respectively.

Although only a single weight 78 or 79 is shown on each side of base member 48 in FIGS. 1 to 5, as seen in FIG. 6, a weight 81, otherwise identical to weights 78, 79, is shown having a threaded shaft 82 (also otherwise identical to shaft 80). Weight 81 has a threaded aperture 83 threadably receiving therein a threaded shaft 84 of a second like weight 85. In this manner, a plurality of weights may be provided on each side of base member 48 to vary the weight and thus the energy required to lift base member 48 and the weights thereon, as will be discussed further hereinbelow.

In operation, the user adjusts the spacing between upright portions 21 of flanges 11, 12, the amount of weight carried by base plate 48, and the amount of tension on cable 26 (by varying the location of pin 75 in holes 73). The user then places his or her foot on top of rotary plate 15 between upright portions 21 (FIG. 1) and rotates plate 15 from the solid line position of flanges 11, 12 in FIG. 2 to the dotted line position in the direction of arrow 86. This of course pulls cable 26 from the solid line position in FIG. 2 to the dotted line position. It can be appreciated that, initially, the cable 26 is not under tension and a certain amount of slack is present until cable 26 is tensioned and the weighted base member 48 is lifted up rods 51, 52 away from base plate 13 (see the dotted line position in FIG. 4). However, the slack in the cable can be eliminated completely to produce instant resistance (of the selected weight) to rotary efforts of the lower extremity. This adjustment increases the range over which rotational effort is applied. This is shown in FIG. 7 wherein like numerals refer to like parts of the embodiment of FIGS. 1 to 7. As seen, the parts are in the solid line start up position of FIG. 2 but the slack in cable 26' has been eliminated.

Again, the weights on base member 48 may be varied. Although a metallic base plate 13 has been discussed, any suitable materials, such as wood, plastic, etc. may be used where appropriate. Cable 26 should preferably be of a material strong enough to lift weighted base member 48 yet flexible enough to pass about sheaves 29, 30, 45, and 47. It should also be relatively rigid so that there is an absence of too much resiliency such that the plate 15 cannot be rotated sufficiently far enough to lift weighted base member 48.

It can be seen that sheaves 29, 30, 45, and 47 cooperate as guide means to guide cable 26 between rotary plate 15 and weighted base member 48 so that rotation of plate 15 lifts member 48 upwardly along guide rods 51, 52.

There is thus disclosed an exercising device which provides resistance to rotation produced by the lower extremity. The application of resistance is accomplished by securing the foot in a simple slot formed by spaced guide members mounted on a rotating plate 15. Plate 15 is free to rotate about a central vertical axis in a horizontal plane. As the plate 15 is rotated, cable 26 wraps around the plate perimeter as it pulls on the resistance of weighted base member 48. Using the plate 15, resistance to rotation can be applied in any suitable manner, using weights, springs, etc. Preferably, both concentric and eccentric contraction is performed isotonicly using sheaves and a weight.

The purpose of exercising the lower extremity with the platform is to provide a controlled, training level stress to the muscular stabilizers of the hip, knee and ankle. As the muscles become stronger with training, the articulation will be allowed to withstand an increased level of stress before ligamentous injury or failure. The application of stress in this manner will lead to a specific adaptation of these stabilizers to the demands imposed on them during sports such as downhill skiing, football, and basketball. Often during these activities, uncontrolled medial or lateral rotation are combined with varus or valgus overload, leading to failure of the medial and lateral ligamentous stabilizers of the knee.

Careful examination of the musculature most involved in producing rotational movements is essential. The knee, being the most vulnerable to the described mechanism of injury, is used as an example.

Structurally, on the medial aspect, the conjoined tendon of the sartorius, gracilis and semitendinosus (*Pes anserinus*) lie over the medial collateral ligament. On the lateral aspect, the tendon of the biceps femoris covers the lateral collateral ligament and is closely associated with the insertion of the iliotibial tract.

Functionally, strengthening of the musculature of medial and lateral rotation may increase their stabilizing effect. Electromyographic studies using surface electrodes suggest that the higherarchey of contribution to rotation is: *gracilis, semitendinosus, tensor fasciae latae, sartorius*. Medially, the musculature of the conjoined tendon of the *sartorius, gracilis*, and *semitendinosus* may resist medial stress on the medial collateral ligament. These muscles produce medial rotation and can be exercised in this manner. On the lateral aspect, strengthening the *biceps femoris* and the *tensor fasciae latae*, both lateral rotators, may assist the lateral collateral ligament in resisting lateral stress. The means to accomplish this training of medial and lateral rotation is provided by rotary plate 15.

Device 10 is a unique modality in that it is designed specifically to exercise and strengthen the musculature stabilizing the articulations of the lower extremity.

The rotary exercising device 10 disclosed herein means to strengthen the muscular stabilizers of the lower extremity. Strengthening this musculature in a rotational fashion may lead to increased protection of the ligamentous structure commonly injured when severe demands are placed on them through rotation with varus or valgus stress. The device 10 is a practical alternative to very expensive isokinetic machines which also accommodate rotational movements of the lower extremity and has the advantage of improved proprioceptive function and closer simulation of the actual movements encountered in sports.

I claim:

1. An exercising device comprising:

only one base plate having an upper surface;

a rotary plate having an upper surface rotatably mounted on said upper surface of said base plate;

a pair of spaced guide members mounted on the upper surface of said rotary plate and having vertically extending laterally and angularly adjustable spaced upright portions;

only one elongated member having one end connected to said only one rotary plate generally at the periphery thereof;

a pair of spaced vertical upright members mounted on the upper surface of said base plate spaced from said only one rotary plate;

only one weighted base member freely mounted on said upright members and slidable therealong from a first position abutting against said base plate to a second position disposed away from said base plate; and said only one elongated member extending between a first single guide means mounted on said base plate between said weighted base member and said only one rotary plate and guiding said only one elongated member in a first direction generally parallel to said upper surface of said base plate through a single second guide means disposed between said first single guide means and said only one weighted base member guiding said only one elongated member in a second direction generally parallel to said upright members to a third single guide means mounted at the top of said upright members guiding said only one elongated member in a third direction also generally parallel to said upright members but spaced therefrom, said only one elongated member extending from said single third guide means to said only one weighted base member and coupled thereto.

2. In the device of claim 1 wherein said rotary member includes a bearing rotatably mounted in a bearing member coupled to said base plate.

3. In the device of claim 1 wherein said elongated member is a rigid wire cable.

4. In the device of claim 1 wherein said first guide means includes a pair of grooved sheaves rotatably mounted on said base plate, each of said sheaves rotating about an axis generally perpendicular to the upper surface of said base plate and contiguous to each other, said elongated member passing between the grooves in said sheaves.

5. In the device of claim 4 wherein said second guide means includes a third grooved sheave rotatably mounted on said base plate and rotatable about an axis extending generally parallel to said upper surface of said base plate, said elongated member passing about the groove of said third grooved sheave.

6. In the device of claim 5 wherein said third guide means includes a fourth grooved sheave rotatably mounted at the top of said upright members and rotatably about an axis generally parallel to the upper surface of said base member.

7. In the device of claim 1 including tension adjusting means associated with said elongated member and said weighted base member for adjusting the tension between said weighted base member and said rotary member.

8. In the device of claim 7 wherein said tension adjusting means includes a pin fixedly mounted in said weighted base member, said elongated member being threadably coupled to said pin.

9. In the device of claim 8 wherein said tension adjusting means further includes height adjusting means associated with said pin and said base member for adjusting the overall height of said pin with respect to said weighted base member.

10. In the device of claim 1 wherein said weighted base member includes at least one weighted member removably mounted thereon.

11. In the device of claim 1 wherein said weighted base member includes at least a pair of weighted members, each of said weighted members being removably mounted to said base member at opposed ends thereof.

12. In the device of claim 11 includes a second pair of weighted members, each of said second pair of weighted members being removably mounted to respective ones of said first mentioned pair of weighted members.

* * * * *